United States Patent [19]

Manlove

[11] 4,403,700

[45] Sep. 13, 1983

[54] MODULAR OFFICE ACCESSORY FOR PERSONAL ITEMS

[76] Inventor: Marvin D. Manlove, 6833 Oak Ter., Kansas City, Mo. 64113

[21] Appl. No.: 263,775

[22] Filed: May 15, 1981

[51] Int. Cl.[3] ..... A47F 5/08

[52] U.S. Cl. ..... 211/88; 312/245; 211/71

[58] Field of Search ..... 211/71, 88; 248/243, 248/224.4, 225.2; 312/245

[56] References Cited

U.S. PATENT DOCUMENTS

| | | | |
|---|---|---|---|
| 2,656,933 | 10/1953 | Pierie | 211/88 |
| 3,078,016 | 2/1963 | Judy | 312/245 X |
| 3,502,294 | 3/1970 | Kalbow et al. | 211/71 X |
| 3,759,297 | 9/1973 | Anderson | 248/243 X |
| 3,851,936 | 12/1974 | Muller | 312/245 |
| 3,899,228 | 8/1975 | Schreiber | 312/245 X |
| 3,909,089 | 9/1975 | Springer | 312/245 X |
| 4,154,356 | 5/1979 | Shieve | 211/88 X |
| 4,160,570 | 7/1979 | Bridges | 211/88 |
| 4,184,433 | 1/1980 | Green | 211/88 X |
| 4,194,636 | 3/1980 | Byram et al. | 211/71 |

*Primary Examiner*—Ramon S. Britts
*Assistant Examiner*—P. A. Aschenbrenner
*Attorney, Agent, or Firm*—Herzig & Walsh, Inc.

[57] ABSTRACT

An office accessory or utility constructed in the form of a frame or holder that forms a trackway for a plurality of individual modules. Modules are provided individually designed for holding different office items such as pencils, ashtray, photograph, clock, memo pad, calendar, business cards, tape dispenser, paper organizer, etc. The frame structure is constructed to be utilizable either on a horizontal surface or suspended from a vertical surface or vertical columns. The modules are positionable in any desired order in the accessory and are readily slideable along its length. Separate individual divider members are provided that are insertable in the accessory trackway to provide individual compartments of desired size and position for holding office supplies or items used.

8 Claims, 14 Drawing Figures

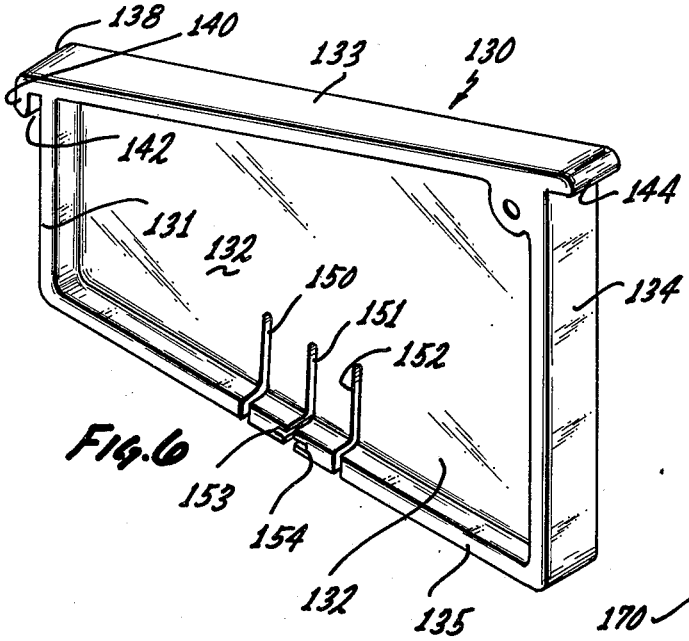
Fig. 6
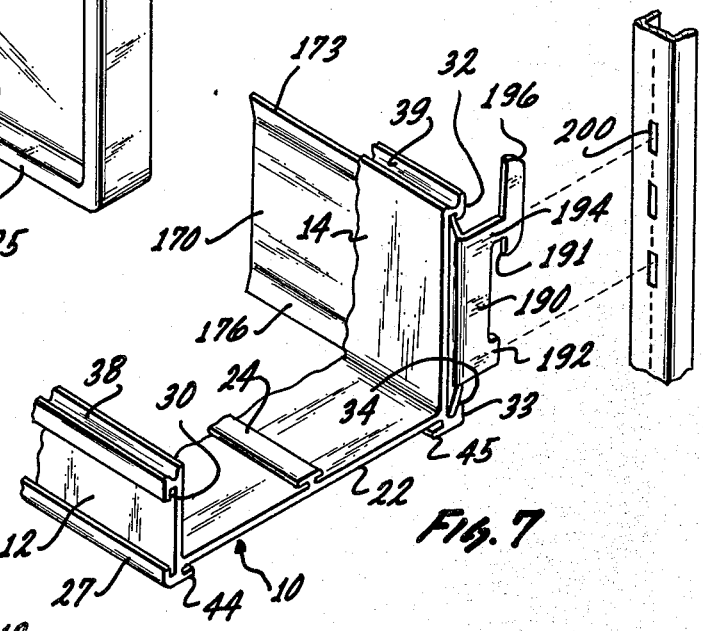
Fig. 7
Fig. 8
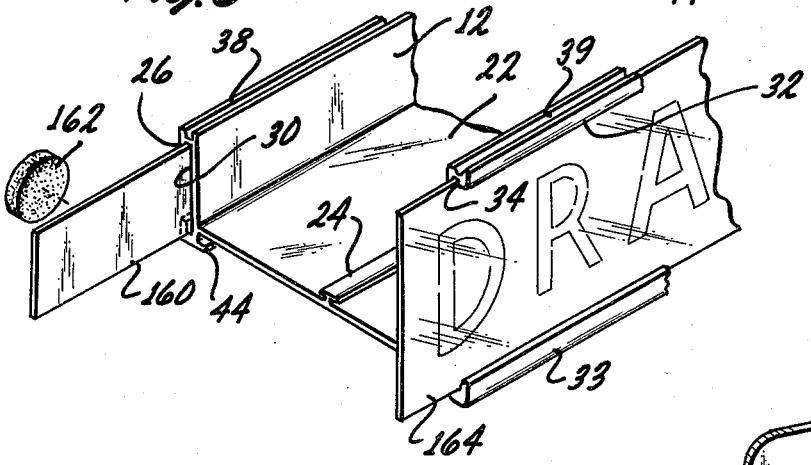
Fig. 9
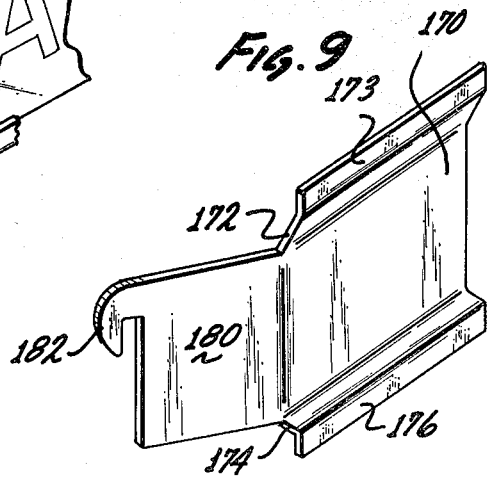

MODULAR OFFICE ACCESSORY FOR PERSONAL ITEMS

BACKGROUND OF THE INVENTION

1. Field of the Invention

The field of the invention is that of an office accessory or utility constructed and adapted for positioning and holding the effects or items normally utilized by individual office personnel.

2. Description of the Prior Art

Research and observation of office environments indicate that office personnel require accessories which contribute to organization of their personal effects and work habits. Accessories as known in the prior art have not been available or have offered inadequate solutions to this real need.

Whether in open plan or conventional environments, the accessory solution must assist both the designer and management in contributing to improvement in the visual aspects of the office. This is an area which the prior art leaves open to improvement and innovation.

SUMMARY OF THE INVENTION

In a preferred form of the invention as described in detail herein, it embodies an accessory or holder preferably in the form of an aluminum extrusion forming a track for individual modules. Other materials may be used. Preferably the track is provided in various standard or custom lengths.

The accessory or accessory track is constructed to be adapted for use either on horizontal surfaces or vertical surfaces, interchangeable bracket attachments being provided for securing the accessory track to a vertical wall or column of a system panel.

A plurality of individual function modules in the form of holders for various items are provided and which include rails whereby the modules are slideable to different positions as desired on the accessory track. Individual modules are constructed to be adapted for holding different items such as pencils; an ashtray; a photograph; a clock; a memo pad; a calendar; Rolodex; business cards; tape dispenser; and paper organizer.

Preferably, also, removable and interchangeable dividers are provided which are insertable in the accessory track and held by a snap fit so as to facilitate dividing the accessory track into individual compartments of desired size and position for holding items used by office personnel.

In the light of the foregoing, a primary object of the invention is to provide an accessory or holder adapted to the needs of office personnel to provide a single point of control for organization of those items customarily used by office personnel.

A further object is to make available an office accessory of the type identified which is constructed to be adaptable to individual preferences and in any office environment. A corollary object is to provide an accessory as identified appropriately scaled as to size; of modular construction so as to be adaptable to individual needs; to be interchangeable with office system arrangements; and economical.

A further object is to make available an accessory of the type identified having the capability of organizing the placement and positioning of all of the office items and needs that an office worker utilizes in such a way as to provide centralized, fingertip availability of the items.

Further objects and additional advantages of the invention will become apparent from the following detailed description and annexed drawings.

BRIEF DESCRIPTION OF THE DRAWINGS

FIG. 4 is a cross-sectional view of a module adapted for holding pencils and the like;

FIG. 6 is an isometric view of an individual divider member;

FIG. 7 is a partial isometric view of the accessory track illustrating a holding bracket for mounting on a vertical column;

FIG. 8 is a partial isometric view of an accessory track illustrating utilization of guide tracks at the front and back of the unit;

FIG. 9 is an isometric view of another form of supporting bracket;

DESCRIPTION OF THE PREFERRED EMBODIMENT AND BEST MODE OF PRACTICE OF THE INVENTION

Figure 1:
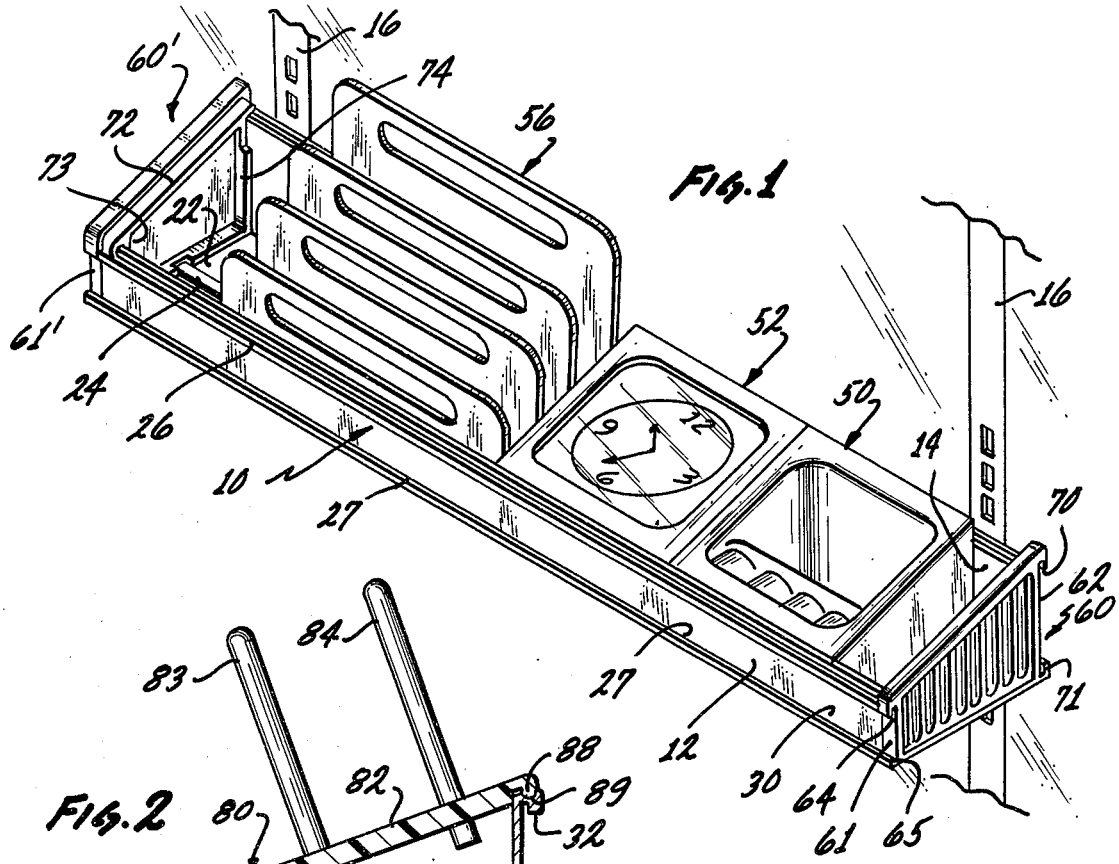
FIG. 1 is a partial isometric view of a preferred form of the invention.

FIG. 1 illustrates a preferred construction of the holder for the individual modules, that is, the accessory or accessory track. As may be seen in FIG. 1, there is provided an elongated holder member 10 for the various modules. Preferably the holder or accessory track 10 can be in the form of an aluminum extrusion or it could be made by a plastic injection molding process. The accessory track has a front wall 12 and a higher back wall 14 so as to provide a slanted top opening. It is to be understood, however, that the accessory track can be utilized either on a horizontal surface or supported from a vertical surface or vertical columns such as the column as shown at 16 in FIG. 1.

Figure 2:
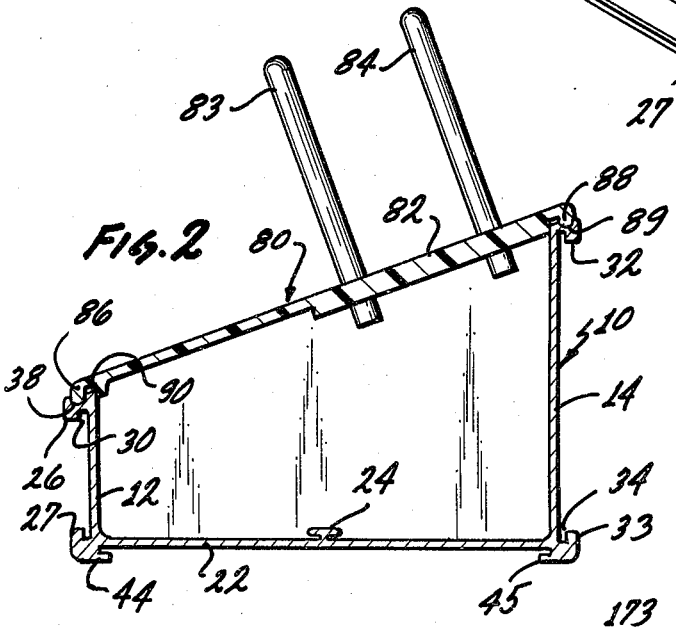
FIG. 2 is a sectional view of a part of the invention illustrating a module adapted for holding a calendar.

The cross section of the trackway is illustrated in FIG. 2. The bottom wall 22 has a central dovetail or rib 24 for a purpose which will be referred to presently. The front side 12 has inwardly directed lips or lugs 26 and 27 which form a guide track 30. The back wall 14 has similar lugs or lips 32 and 33 which form a trackway 34 for holding a support bracket as will be described.

Formed in the lip 26 is a longitudinal groove 38 and a similar groove 39 is formed in the lip 32. These grooves form guide rails or guide tracks permitting individual modules to slide lengthwise along the accessory track as will be described.

The bottom wall 22 has inwardly directed lips or lugs 44 and 45 which form a similar trackway which can be used in a manner which will be described.

Figure 3:
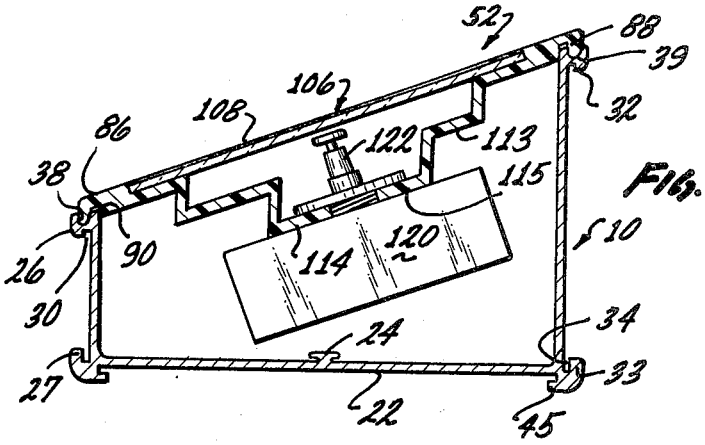
FIG. 3 is a cross-sectional view showing a module adapted for holding a clock.
Figure 4:
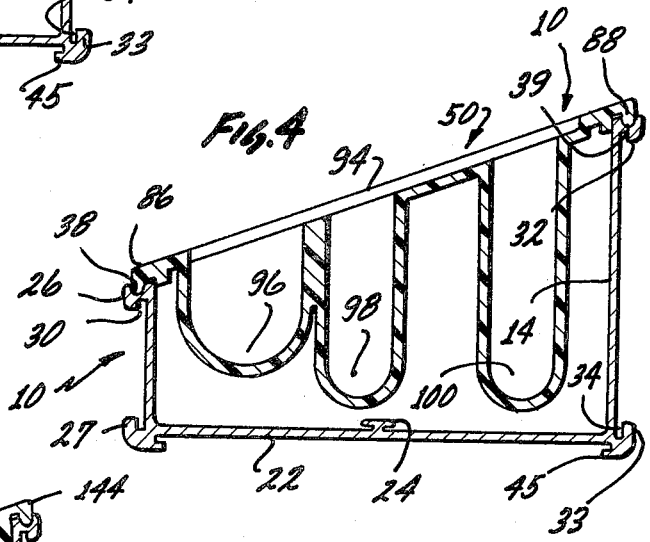

FIG. 1 illustrates an individual module 50 which is shown in cross section in FIG. 4. Numeral 52 designates an individual module which is shown in cross section in FIG. 3.

Numeral 56 designates a group of plates or panels that fit into grooves in the bottom of the accessory track 10 with spaces between them for positioning and organizing papers and similar flat materials.

Numerals 60 and 60' designate end panels for the accessory trackway. Referring to the end member or panel 60, it has a front side 61 and a backside 62. The front side 61 has inwardly extending lips 64 and 65 which form continuations of the lips 26 and 27 on the front wall 12 and a continuation of the guide track formed by them. The backside 62 of the panel 60 has inwardly directed lugs or lips 70 and 71 which form continuations of the lips 32 and 33 on the back wall 14.

The other end panel 60' is like the panel 60 and need not be described in detail. However, as may be seen on the inside of the end panel 60', there is a continuous inwardly extending rib 72, the side parts of which as shown at 73 and 74 are spaced inwardly from the front 12 and back 14 of the trackway so that its ends can fit into the recesses formed, the end members or end panels being secured by being glued or otherwise to the trackway 10.

FIG. 2 is a cross-sectional view showing a cross section of a module identified by numeral 80 which is a module constructed to receive a calendar, the module providing a flat surface 82 with two upstanding posts 83 and 84 to receive the calendar. The module 80 may be formed of any suitable material such as plastic. At the front and back edges it has downwardly extending ribs 86 and 88 which form sliding elements or rails so that the module can slide along the trackway 10 with the ribs 86 and 88 sliding in the grooves 38 and 39 in the top of the side walls 12 and 14. Numeral 90 designates a groove in the underside of the forward edge of the member 82 of the module 80 which receives the top edge of the front wall 12 which slides in it.

FIG. 1 shows two modules 50 and 52 which are shown in cross section in FIG. 4 and in FIG. 3. Module 50 as shown in FIG. 4, has a top panel 94 in which are formed openings or recesses having depending formed portions 96, 98, and 100 configurated to receive pencils or similar types of objects that can be inserted in the top panel 94. The top panel 94 is otherwise constructed like that of the module 80 so that the module can slide along the grooved rails formed at the top of the accessory trackway 10.

Referring to FIG. 3, the module 52 has a top panel as designated at 106 which includes a transparent insert portion 108. The ribs or rail members formed at the front and back edges of the module 106 are like that of the module 80. The top panel 106 has an integral inwardly extending part which includes the parallel portions 112 and 113 and 114 and 115 with connecting right angular portions. The inner parallel portions 114 and 115 have attached to them a clock as designated at 120 having an adjusting stem 122 which extends out to the panel 108, which is removable.

The spacer panels of the group designated by the numeral 56 fit into slots formed in a rectangular base that fits into the bottom of the accessory trackway 10 and is removable or can be slid along the length of the trackway.

Each of the module as already described can be slid in the trackway as desired. They are readily removable and can be replaced in the trackway in any desired position. The device has these capabilities whether it is used supported on a horizontal surface or attached to a vertical surface or to vertical columns as will be described.

Numeral 130 designates a spacer member or divider, a plurality of which are provided. Each divider can be positioned at any desired point in the accessory trackway 10 to provide compartments of desired size and position. The divider 130 includes panel 132 having a shape corresponding to the cross-sectional shape of the accessory track 10. Formed at the sides, top, and bottom of the panel 32 is a continuous transverse rib having a front part 132, a top part 133, a back part 134, and a bottom part 135. The ends of the top part 133 have an overhang as shown, the front overhang 138 having a downwardly extending lip 140 forming a groove 142 which forms a trackway that can ride on the top edge of the front wall 12 of the trackway 10. The overhang 44 at the other end of the part 133, can fit over the top of the back wall 14.

Figure 5:
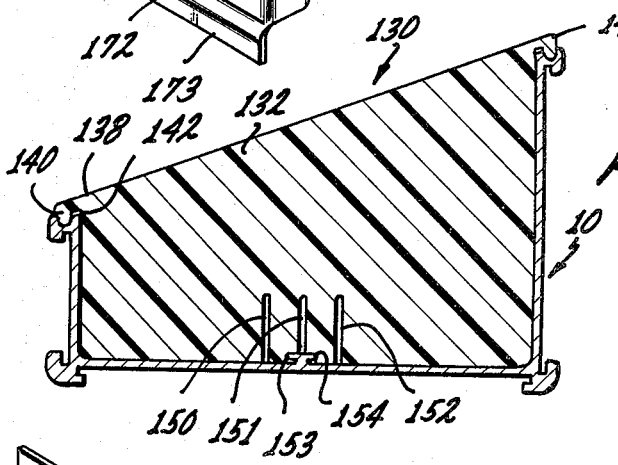
FIG. 5 is a cross-sectional view illustrating a removable divider.

At the mid-point of the bottom of the divider 132 are three slots 150, 151, and 152 spaced apart as shown. The slot 151 is in the bottom rib 135 as well, and in the side edges of the slot in the rib are recesses 153 and 154. The slot 151 and the recesses 153 and 154 form a spring detent to provide a snap fit of the portions of material adjacent to the slot 151 to fit over the dovetail or rib 24 in the bottom 15 of the accessory trackway 10. See FIG. 5.

As pointed out in the foregoing, the accessory track or holder can be made use of on a horizontal surface or being supported or suspended from a vertical surface of from vertical columns or vertical hangers.

FIG. 8 illustrates utilization of the guide track formed by the front wall 12 to receive a sliding strip of material as designated at 160 to which memos can be secured by way of a circular permanent magnet as shown at 162. FIG. 8 also shows a nameplate 164 inserted in the trackway formed at the outside of the back wall 14.

FIGS. 9, 10, 11, 12, 13, and 14 show different forms of brackets or bracket clips which can be utilized in connection with the track at the back wall 14 of the holder to facilitate supporting or mounting the device from any available support surfaces or columns that may be available in the office environment.

The bracket shown in FIG. 9 is in the form of a flat plate 170 having a flange including slant part 172 and a straight part 173 along one edge. The flat part has a right-angle flange 174 at the other edge which has a parallel flange part 176. Extending from one end of the flat plate part 170 is a plate part 180 which is at an angle and the outer edge of which has a hook part 182, the end of which is spaced from the edge of the plate 180.

Figure 10:
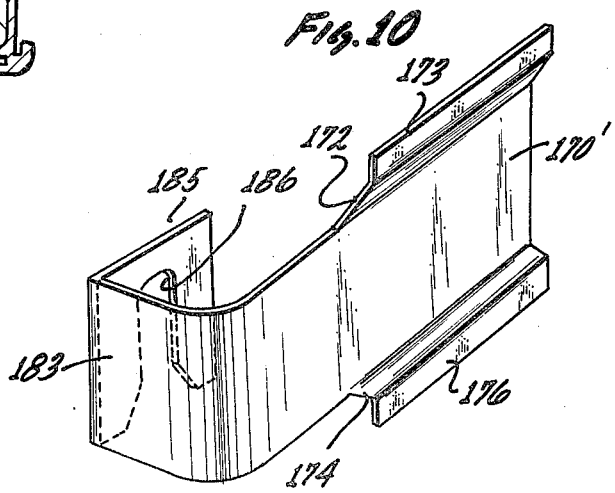
FIG. 10 is an isometric view of another form of supporting bracket.

FIG. 10 shows another form of bracket which is like that of FIG. 9 except as follows. The flat plate part 170' has a longer extent and at its end it has a right-angle part 183 and a second right-angle part 185 spaced from the plate part 170', the plate part 183 having an intermediate slot 186 in it. The manner of utilization of the brackets will be described presently.

Figure 11:
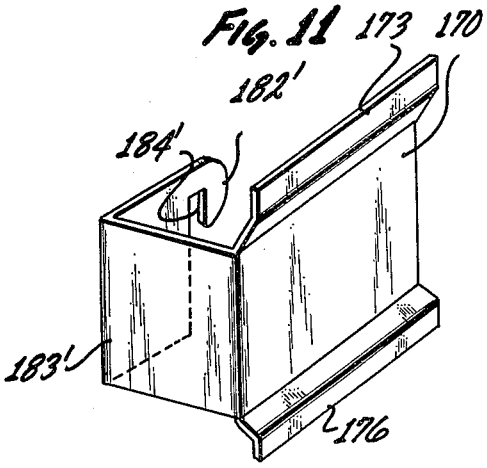
FIG. 11 is an isometric view of another form of supporting bracket.

FIG. 11 shows another form of bracket which is similar to that of FIGS. 9 and 10 except as follows. The right-angle part 183 extends directly from an end of the flat plate part 170 and at its end is a right-angle plate part 183' having a hook 182' and slot 184' like corresponding parts in FIG. 9.

Figure 12:
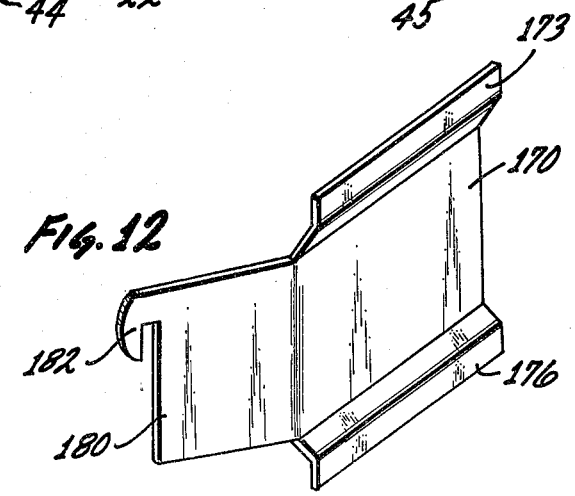
FIG. 12 is an isometric view of another form of supporting bracket.

FIG. 12 shows a bracket like that of FIG. 9 but only having the plate 180 bent at a different angle relative to the part 170.

Figure 13:
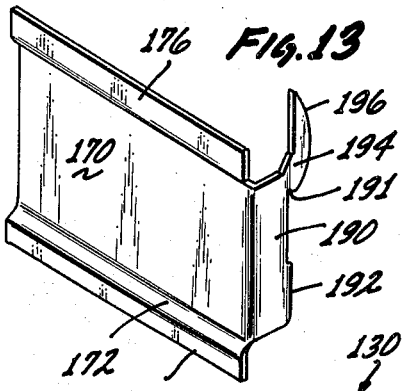
FIG. 13 is an isometric view of another form of supporting bracket.

FIG. 13 shows another form of bracket which is like those already described except that at the end of the plate part 170 there is a right-angle flange 190 having a cutout 191 in it with extending lug 192 at the bottom end of the cutout and an extending lug 194 at the upper end with a hook element 196 extending from the lug 194 and bent at an angle as shown. FIG. 7 shows a bracket which is in all respects like that of FIG. 13 except that the hook element 196 is parallel to, that is, it lies in the same plane as the lug 194 instead of being bent at an angle. FIG. 7 shows the support column 16 having in its slots as shown at 200 which are spaced apart in a vertical direction. The support bracket shown in FIG. 7, which is similar to that of FIG. 13, is held in the track formed in the back wall 14 of the accessory trackway in the guide trackway formed by the lugs 32 and 33 shown in FIG. 2. The entire accessory trackway can readily be slid along the bracket. The lower flange 176 fits into the lower guide track formed by the lug or rib 33 and the upper flange 173 fits into the upper guide track inside of the lug or rib 32. The lug 192 on the bracket fits into one of the vertical slots 200 at column 62 after the hook element 196 has been inserted into one of the slots 200 with the whole device then being lowered so that the bottom part of the hook 196 hooks into the lower part of the slot 200 and the lug 192 fits ito another of the slots 200.

In a manner similar to the foregoing, the bracket as shown in FIG. 9 can be utilized with the hooks like the hook 182 hooking into slots like the slot 200 in upright columns.

The bracket as shown in FIG. 11 can be utilized in a similar manner to support the accessory track, the hook 182' being utilized to hook into a support column 16 which may be in a different position, that is, with the surface having the openings 200 being normal to rather than facing the surface of the bracket.

The bracket as shown in FIG. 10 is utilized wherein it may be desired to support the accessory track not from a column such as shown at 16 but from bolts or other elements driven into a wall or vertical surface. The slot as shown at 186 would fit down over an extending bolt so that the device would be supported in this manner.

Figure 14:
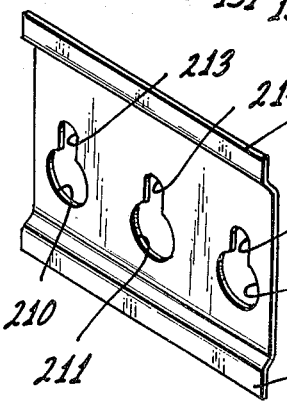
FIG. 14 is an isometric view of a still further form of supporting bracket.

FIG. 14 shows a type of bracket that is similar to those already described but without having any extensions but instead having a group of holes as shown at 210, 211, and 212, the holes having slots at their undersides as shown at 213, 214, and 215. In utilizing this type of bracket the openings in the bracket are simply fitted over the heads of screws or bolts, the shanks of the supporting elements then engaging in the slots.

From the foregoing, those skilled in the art will readily understand the nature of the invention, its manner of utilization and the manner in which it achieves all of the foregoing objectives and purposes. It will be seen that the invention as described in detail provides a needed and highly utilitarian article universally adaptable to be utilized in, and coordinated with office environments. The tools, implements, utensils, and items normally used by the office worker are relatively at hand and the capability is realized of maintaining them in an orderly, uniform manner as desired by the user and facilitating the capability of quick availability and utilization of any item.

The foregoing disclosure is representative of a preferred form of the invention and is to be interpreted in an illustrative rather than a limiting sense, the invention to be accorded the full scope of the claims appended hereto.

What is claimed is:

1. As an article of manufacture, in combination, means forming an integral frame structure having ends constructed to support individual modular holders for office accessories, a plurality of individual holders forming modules constructed to be held in the frame structure, the frame structure having a flat bottom an open top to receive and hold the said modules, the said frame structure having a front wall and a back wall the front wall being lower then the back wall, the top edge of each wall forming a rail so as to provide a trackway, the modules each having an upper part having front and back portions formed to engage said rails to be slideable along the trackway, each of the modules being constructed to allow it to be manually removable and replaceable with respect to the frame structure, each individual module, having an office accessory carried by the said upper part within the said frame structure, the said frame structure being constructed so as to be adapted to be movably supported on a horizontal surface and having means for attachment to a vertical surface.

2. An article as in claim 1 including support bracket means whereby the frame structure can be supported from a vertical surface, the frame structure having at least one side forming a guide track, at least one support bracket having parts formed to be engaged in the said guide track whereby to allow horizontal movement of the frame structure, the said bracket having means for securement to a vertical member.

3. An article as in claim 1 including divider members constructed to fit into the frame structure transversely, the said dividers and the frame structure having mutually engageable parts constructed to engage with a snap fit to removably hold the dividers in position.

4. An article as in claim 1 wherein the said frame structure is an elongated extrusion having a length for holding a plurality of modules and including end plates secured to the extrusion forming end walls.

5. An article as in claim 1 wherein the upper edges of the walls of the frame structure have grooves in them providing guide rails, the front and back edges of the upper part of each of said modules having downwardly extending ribs forming elements adapted for sliding along the guide rails.

6. An article as in claim 2 wherein the bracket securement means includes an extending portion of the bracket having a hooklike element adapted for engagement in an opening in a supporting surface.

7. An article as in claim 6 wherein the said bracket securement means includes a second element, the elements having relative positions adapted for both of the elements to be inserted into openings formed in a supporting surface.

8. An article as in claim 3, said mutually engageable parts including a longitunal dove tailed rib at the bottom of the frame structure each divider having a plurality of vertical slots at the bottom forming elements between the slots configurated to receive the said dove tailed rib in holding relationship.

* * * * *